US006119971A

United States Patent [19]

Jones

[11] Patent Number: 6,119,971

[45] Date of Patent: Sep. 19, 2000

[54] ROTATING ARM DECOILER WITH VARIABLE TENSION CONTROL

[75] Inventor: Johnnie L. Jones, Rockford, Mich.

[73] Assignee: Accra-Wire Controls Inc., Rockford, Mich.

[21] Appl. No.: 09/204,787

[22] Filed: Dec. 3, 1998

[51] Int. Cl.[7] ..... B65H 16/04

[52] U.S. Cl. ..... 242/420.6

[58] Field of Search ..... 242/417.3, 417, 242/418.1, 420.5, 420.6, 563, 564; 226/44

[56] References Cited

U.S. PATENT DOCUMENTS

| | | | |
|---|---|---|---|
| 270,368 | 1/1883 | Barlow . | |
| 2,955,813 | 10/1960 | Hume . | |
| 3,090,399 | 5/1963 | Godshalk . | |
| 3,199,805 | 8/1965 | Kohn et al. . | |
| 3,282,518 | 11/1966 | Holmes . | |
| 3,476,330 | 11/1969 | Curtland . | |
| 4,249,705 | 2/1981 | Brooks et al. . | |
| 4,304,370 | 12/1981 | Box et al. . | |
| 4,569,467 | 2/1986 | Kaminstein . | |
| 4,582,271 | 4/1986 | Takahashi . | |
| 4,848,694 | 7/1989 | Julian . | |
| 4,899,945 | 2/1990 | Jones . | |
| 4,979,692 | 12/1990 | Julian . | |
| 5,007,597 | 4/1991 | Jones . | |
| 5,100,074 | 3/1992 | Jones . | |
| 5,123,607 | 6/1992 | Jones . | |
| 5,803,393 | 9/1998 | Julian | 242/420.6 |
| 5,887,816 | 3/1999 | Jones | 242/420.6 |

*Primary Examiner*—Donald P. Walsh
*Assistant Examiner*—William A. Rivera
*Attorney, Agent, or Firm*—Price, Heneveld, Cooper, DeWitt & Litton

[57] ABSTRACT

A dereeler for spooled strip and wire materials and the like includes a platform shaped to support a spool of coiled material in a horizontal orientation. A motor is operably connected with the platform and selectively rotates the same in a horizontal plane to pay the coiled material off of the spool. A material control post is disposed in a vertical orientation and mounted for axial rotation. A control is operably connected with the motor and the material control post to actuate the motor and uncoil the coiled material from the spool in response to tension applied to the material. A material guide is connected to the material control post for rotation therewith, and is shaped to pass uncoiled material thereover and apply a preselected tension to the material to facilitate smooth material feeding. A variable tensioner is connected with the material control post and generates the preselected tension that is applied to the material, the tensioner being adjustable to vary the preselected tension such that the dereeler can be quickly and easily adapted for use with a wide variety of differently sized spooled strip and wire materials.

20 Claims, 6 Drawing Sheets

ROTATING ARM DECOILER WITH VARIABLE TENSION CONTROL

BACKGROUND OF THE INVENTION

The present invention relates to automatic dereelers and uncoilers, and more particularly, to an automatic dispensing machine for both wire and flat metal stock with a variable tension control post which allows dereeling of various sizes and shapes of coiled metal stock.

Many industrial operations require the use of a continuous feed of wire or flat stock to make various types of metal parts. This fabrication is often performed by die-stamping or similar metal forming machines and processes. Many of these operations require different sizes of wire or flat stock, which historically has required the use of different automatic dereelers or decoilers for each different size or narrow range of sizes of wire or flat stock to be used. One of the reasons the use of different dereelers is required is that quite different tensions and sizes of guides and control posts or arms on the dereelers are required for different sizes and shapes of stock.

The prior dereeler disclosed in U.S. Pat. No. 4,582,271 utilizes a vertically pivoting arm balanced with a weight to dispense a strip-like thin plate member. However, because a weight inside an enclosed column is used to provide the tension on the swing arm, the apparatus disclosed in U.S. Pat. No. 4,582,271 does not allow for ease of adjustment of the tension of the swing arm, and does not permit fast and easy exchange of various sizes of feed stock to be dereeled.

It is much more economical to use one dereeling machine that can handle various sizes and shapes of feed stock than to purchase and use a number of different dereelers, each to be used with a different size of feed stock or narrow range of sizes of feed stock. Thus, there exists a need for an improved dereeler that can facilitate various sizes and shaped of stock, from small wire stock to thick wide flat stock, that is economical and easy to use.

SUMMARY OF THE PRESENT INVENTION

A dereeler for spooled strip and wire materials and the like includes a platform shaped to support a spool of coiled material thereon in a normally generally horizontal orientation. A motor is operably connected with the platform and selectively rotates the same in a normally generally horizontal plane to pay the coiled material off of the spool. A material control post is disposed in a generally vertical orientation and mounted for axially rotation. A control is operably connected with the motor and the material control post to selectively actuate the motor and uncoil the coiled material from the spool in response to tension applied to the material. A material guide is connected to the material control post for rotation therewith, and is shaped to pass uncoiled material thereover and apply a preselected tension to the material to facilitate smooth material feeding. A variable tensioner is operably connected with the material control post and generates the preselected tension that is applied to the material, the tensioner being adjustable to vary the preselected tension such that the dereeler can be quickly and easily adapted for use with a wide variety of differently sized spooled strip and wire materials.

Another aspect of the present invention provides a dereeler for spooled material and the like, comprising a platform shaped to support a spool coiled material thereon, and a motor operably connected with a platform to selectively rotate the same and pay the coiled material off of the spool. A material control post is mounted on the dereeler for axial rotation, and a control is operably connected with both the motor and the material control post to selectively actuate the motor and uncoil the coil material from the spool in response to tension applied to the material. A material guide is connected with the material control post for rotation therewith, and is shaped to pass uncoiled material thereover and apply a preselected tension to the material to facilitate smooth material feeding. A variable tensioner is operably connected with the material control post, and generates the preselected tension that is applied to the material. The tensioner includes a tensioning arm connected with and extending radially from the material control post, a slide connector supported on the tension arm and adapted to slide longitudinally therealong, a longitudinally extensible biasing member having one end thereof connected with the slide connector, such that shifting of the slide connector along the tensioning arm varies the preselected tension on the material, whereby the dereeler can be quickly and easily adapted for use with a wide variety of spooled materials.

Yet another aspect of the present invention is a material decoiler comprising a coil support platform adapted to support a coil of wire stock in a generally horizontal orientation. A control is operably connected with the coil support platform to selectively uncoil the wire stock from the coil in response to tension applied to the wire stock. A material control post is rotably mounted on the dereeler for axial rotation in an initial position. A variable tension assembly is connected with the material control post, and has an adjustable biasing member to allow rotational movement of the material control post while having adjustable tension to urge the material control post back to its initial position.

The principal objects of the present invention are to provide an automatic dereeler that can be quickly and easily adapted for use in conjunction with a wide variety of differently sized spools striped and wire materials. The dereeler includes a variable tensioner which accurately applies a predetermined tension to the spooled material for reliable dispensing, and is easily adjusted to accommodate different types of materials. The dereeler is quite durable, and has a very uncomplicated design that is adapted to dispense different shapes, such as wire and flat stock, as well as different thicknesses of material, including small to large gauge wire, as well as thick and thin flat stock, including thin foils. The present dereeler selectively feeds coiled stock into an associated fabricating machine that can accommodate intermittent feed rates. Long sections of stock may be drawn from the reel at intermittent speeds and the rotation of the control post allows smooth dereelment of the stock, even at intermittent speeds. The dereeler is efficient in use, economical to manufacture, capable of the long operated life, and particularly well adapted for the proposed use.

These and other features, objects and advantages of the present inventions will become apparent upon reading the following description thereof together with reference to the accompanying drawings.

DETAILED DESCRIPTION OF THE PREFERRED EMBODIMENT

Figure 1:
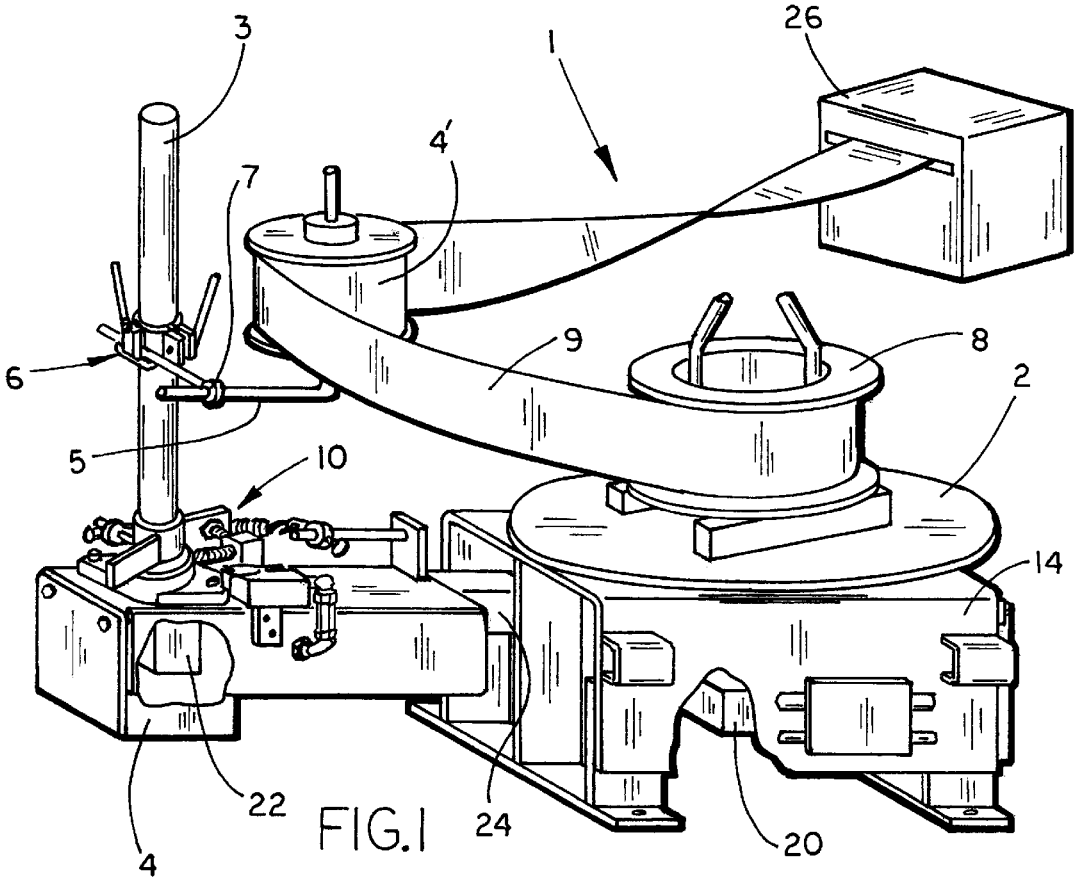
FIG. 1 is a side perspective view of a dereeler embodying the present invention, shown feeding relatively wide and thick flat stock into an associated fabricating machine.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that specific devices and processes illustrated in the attached drawings, and described in the following description are simply exemplary embodiments of the inventive concepts defined in the appended claims. Hence, specific dimensions and other physical characteristics relating to the embodiments disclosed herein are not to be considered as limiting, unless the claims expressly state otherwise.

A dereeler 1 for spooled strip and wire materials and the like includes a platform 2 shaped to support a spool 8 of coiled material 9 in a horizontal orientation. A motor 20 is operably connected with platform 2 and selectively rotates the same in a horizontal plane to pay the coiled material 9 off of the spool 8. A material control post 3 is disposed in a vertical orientation and mounted for axial rotation. A control 24 is operably connected with motor 20 and material control post 3 to actuate motor 20 and uncoil the coiled material 9 from the spool 8 in response to tension applied to the material. A material guide 4' is connected to material control post 3 for rotation therewith, and is shaped to pass uncoiled material thereover and apply a preselected tension to the material to facilitate smooth material feeding. A variable tensioner 10 is connected with material control post 3 and generates the preselected tension that is applied to the material 9, variable tensioner 10 being adjustable to vary the preselected tension such that dereeler 1 can be quickly and easily adapted for use with a wide variety of differently sized and shaped spooled strip and wire materials.

Dereeler 1 (FIGS. 1, 1A, 1B) is designed to be used in conjunction with fabrication machinery, such as a die press or the like. As seen in FIG. 1, dereeler 1 includes generally horizontal platform 2, which is shaped to support the spool 8 of coiled stock 9. Platform 2 is mounted for rotation and is oriented to pay out the coiled stock 9 in a substantially horizontal direction. Material control post 3 has a lower end which is rotatably mounted in a control box 4, which includes a potentiometer 22 to determine the angular orientation of control post 3. Material guide 4' is attached to material control post 3 by an arm 5, and directs the uncoiled stock to an associated metal fabricating machine 26. Arm 5 also includes two adjustable joints 6, 7, discussed in detail below, which permit guide 4' to be shifted to a wide variety of different orientations, thereby adapting the machine for different applications.

Figure 1A:
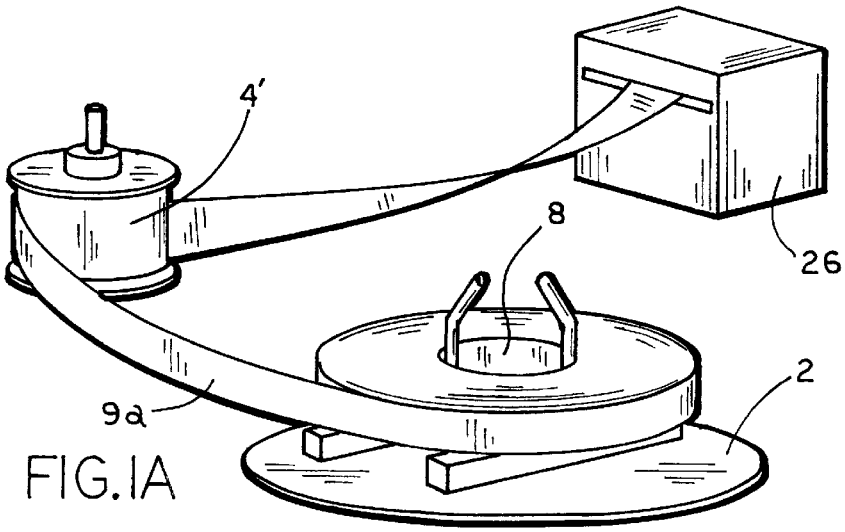
FIG. 1A is a partially schematic perspective view of platform and material guide portions of the dereeler shown feeding a narrower and relatively thin flat stock into an associated fabricating machine.
Figure 1B:
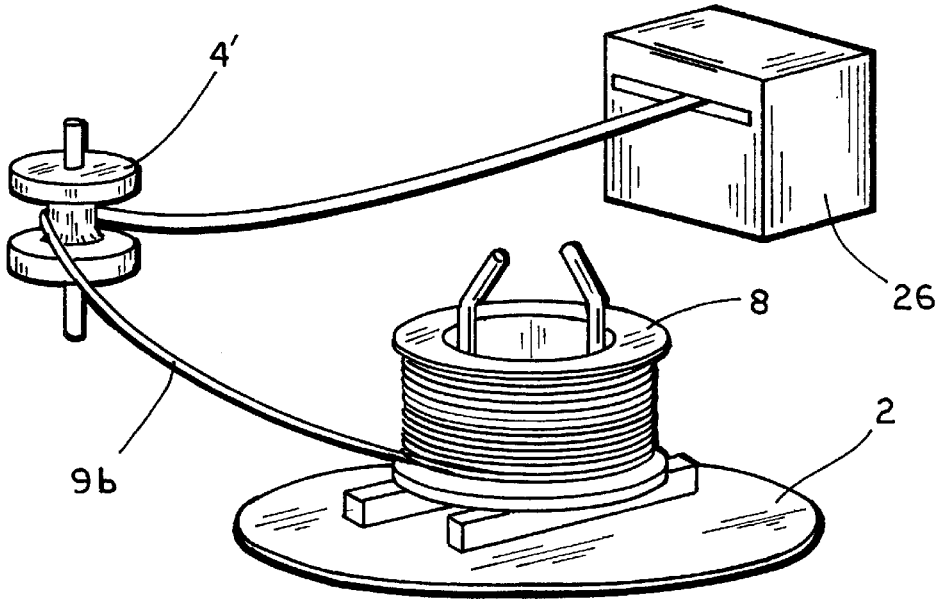
FIG. 1B is a partially schematic perspective view of the platform and an alternate material guide shown feeding wire stocks into an associated fabricating machine.
Figure 2:
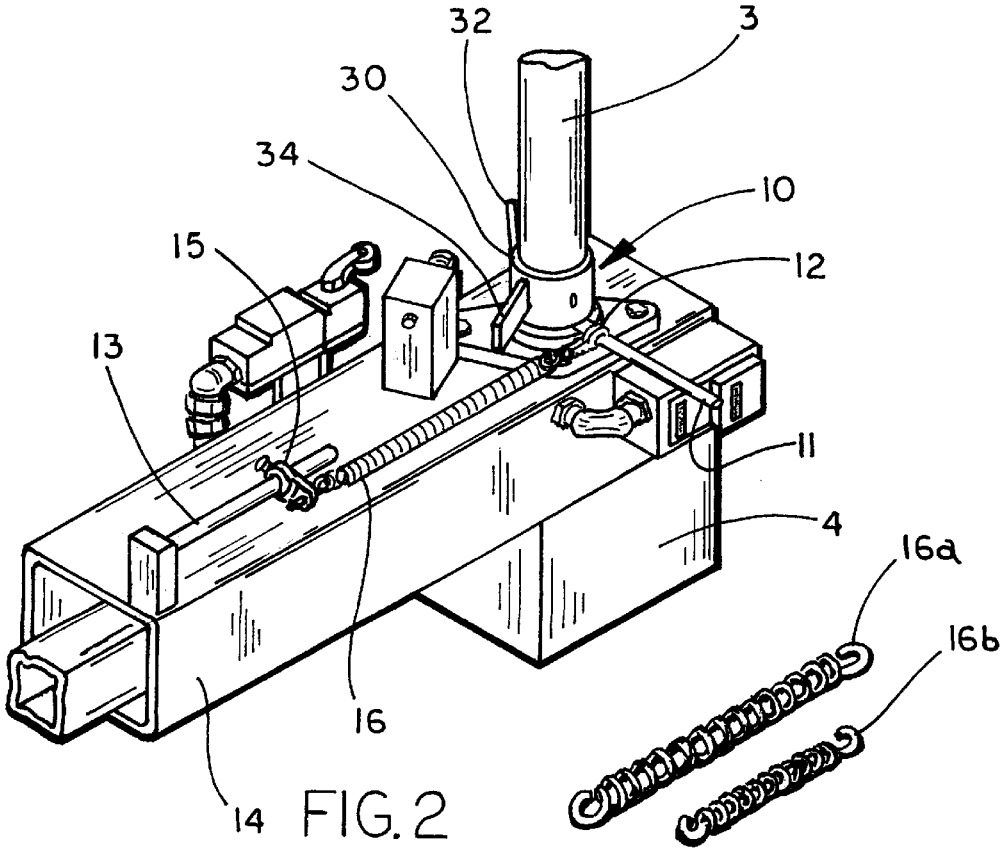
FIG. 2 is a fragmentary perspective view of control and variable tensioner portions of the dereeler.

These different applications are illustrated in FIGS. 1, 1A, and 1B, where a variety of different exemplary metal stocks 9, 9*a*, and 9*b* are shown being used in the dereeler of the present invention. The present invention allows use of a variety of different metal stocks from a wide flat stock 9 such as that shown in FIG. 1, to a narrower flat stock 9*a* such as that shown in FIG. 1A to a thin wire stock 9*b* such as that shown in FIG. 1B, as well as many others.

As shown in FIG. 1, variable tension assembly 10 is provided adjacent the base of the material control post 3 to return control post 3 to its original position when stock is not being payed off of the coil, and also to resist rotation of guide 4' during material pay off. With reference to FIGS. 2–5, variable tension assembly 10 includes a radially extending rod 11 having one end thereof fixably attached to and rotating with material control post 3 via a sleeve 30 which is rotatably fixed to material control post 3. Sleeve 30 has two extensions 32, 34, the operation of which will be discussed in detail below. An adjustment collar 12 is slidably mounted on rod 11, and can easily be adjusted therealong in an axial direction relative to the longitudinal axis of rod 11 by using a thumbscrew 36 to loosen collar 12 to rod 11 and then slide collar 12 along rod 11. Collar 12 can then be fixed on rod 11 by retightening thumbscrew 36.

A second support rod 13 is fixably attached to the frame 14 of dereeler 1, which acts as an anchor post and is oriented substantially horizontal at a location spaced apart from rod 11. An adjustable collar 15 is mounted on rod 13. By loosening a thumbscrew 38, collar 15 can be slidably adjusted in a horizontal direction toward and away from material control post 3 along rod 13 in a manner similar to collar 12. Once the desired location of collar 15 is reached along rod 13, thumbscrew 38 can then be retightened to hold collar 15 in place on rod 13. A coil spring 16 has one end thereof mounted on collar 15, and the opposite end thereof mounted on collar 12 by using an "s" hook 39 on each end of the coil spring, such that rotation of material control post 3 about a vertical axis extends and tenses coil spring 16. Hence, coil spring 16 resiliently urges material control post 3 back toward its initial rotational position.

Figure 3:
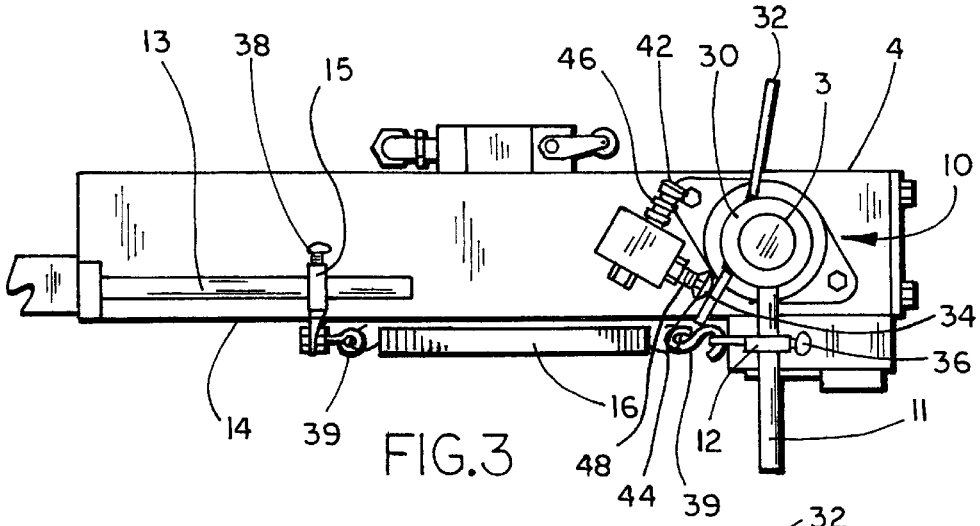
FIG. 3 is a fragmentary top plan view of the control and variable tensioner portions of the dereeler, with a biasing member shown in a low-tension position.
Figure 4:
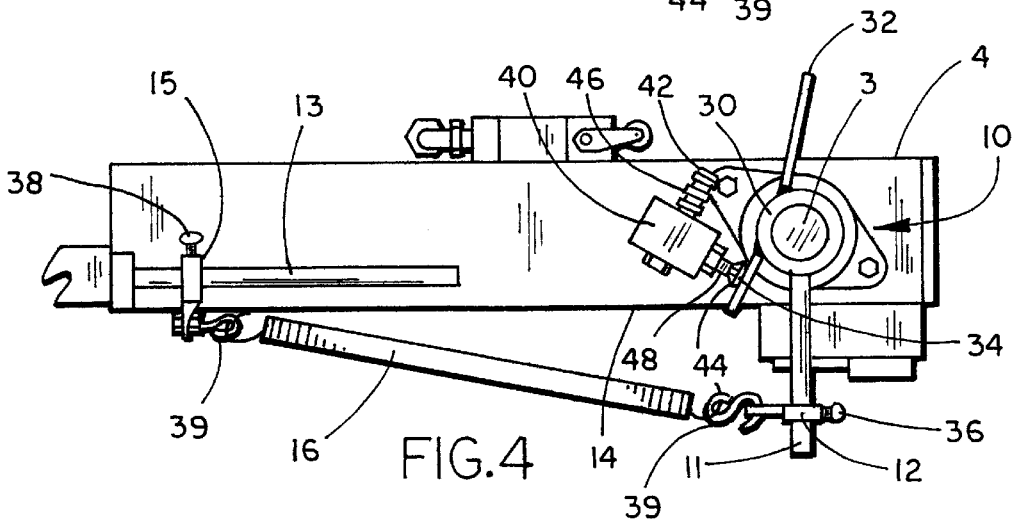
FIG. 4 is a fragmentary top plan view of the control and variable tensioner portions of the dereeler, with the biasing member shown in a high-tension position.
Figure 5:
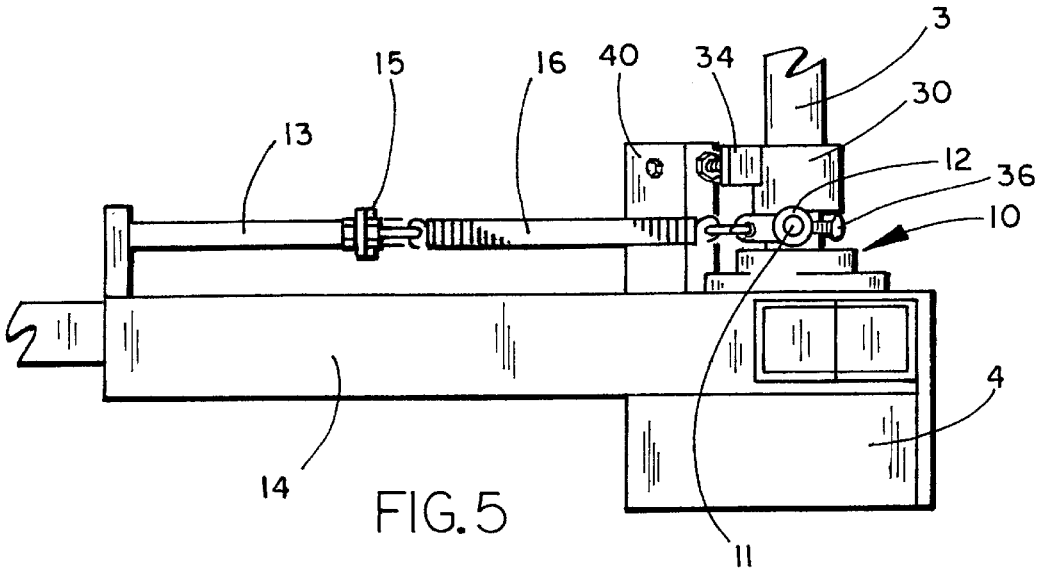
FIG. 5 is a fragmentary side elevational view of the control and variable tensioner portions of the dereeler.

FIGS. 3 and 4 show the variability of tension to be applied to the material control post 3 by adjusting the placement of collars 12 and 15 along rods 11 and 12, respectively, which in turn adjusts the tension in coil spring 16. FIG. 3 shows both collars 12 and 15 moved toward material control post 3 along each of their respective rods. The result is that there is a relatively low tension in coil spring 16. This is in contrast with the situation shown in FIG. 4, where the respective collars 12 and 15 are positioned further away from material control post 3, and thus further away from each other, resulting in a higher tension in coil spring 16. FIG. 5 shows that rods 11 and 13, and thus collars 12 and 15, are generally in the same horizontal plane in the preferred embodiment. However, it is contemplated that such rods and collars may be oriented in different horizontal planes depending on the desired tension in coil spring 16 and the physical construction of the dereeler as a whole.

A rotary potentiometer 22 (FIG. 1) is operably connected to the frame 14, and acts as a sensor to generate a signal as material control post 3 rotates as the stock 9 is being payed off the spool 8 and directed around material guide 4'. Rotary potentiometer 22 is operably connected to control 24, such that the rotation rate of the platform 2 increases in direct proportion to the rotational position of material control post 3. Potentiometer 22 generates a signal that increases the rotation rate of platform 2 in proportion to the angular position of potentiometer 22. As potentiometer 22 rotates from about 0° to 360°, the rotational speed or r.p.m. of platform 2 increases from zero to a selected maximum r.p.m.

As illustrated in FIGS. 3 and 4, frame 14 includes a housing 40 with two plungers 42 and 44 which slidably extend through a bore in housing 40. Two springs 46 and 48 respectively bias plungers 42 and 44 outwardly. If material control post 3 reaches its fully extended rotational position as a result in an increase in the feed rate, spring 46 absorbs the shock from extension 32 to prevent damage to dereeler 1. Likewise, if dereeler 1 decreases the feed rate suddenly, spring 48 absorbs the shock from material control post 3 returning to its initial position by extension 34 engaging plunger 44 and spring 48 absorbing the shock to prevent damage to dereeler 1.

Figure 6:
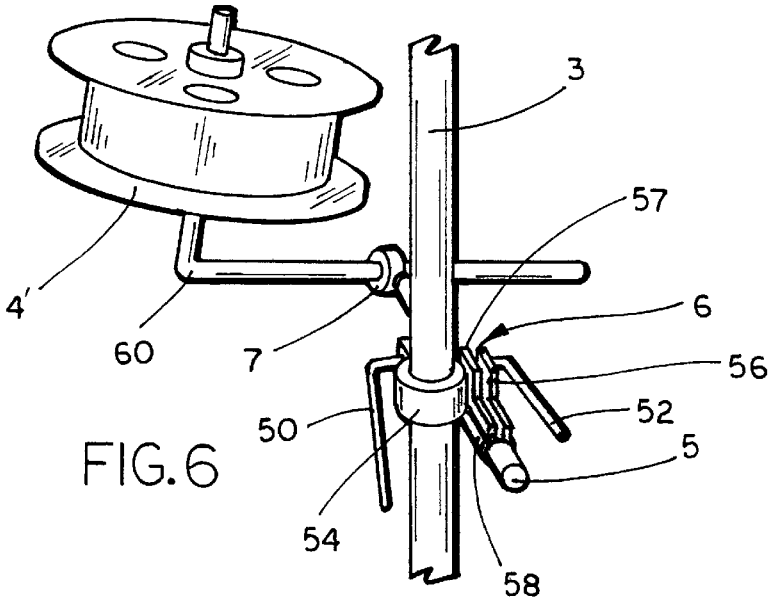
FIG. 6 is a fragmentary perspective view of the material guide and material guide post portions of the dereeler.

With reference to FIG. 6, arm 5 includes two adjustable joints 6 and 7 which permit material guide 4' to be shifted to a wide variety of different orientations, thereby adapting the machine for different applications. Joint 6 includes two threaded handles 50 and 52. Handle 50 is threadably engaged with a collar 54, which when loosened permits adjustment vertically of arm 5. Handle 52 is threadably engaged with two plates 56 and 57 which are part of a collar 58 on arm 5. Handle 52 allows tightening and loosening of the plates 56, 57, and thus tightening and loosening of collar 58 to permit horizontal adjustment of the arm 5. Joint 7 allows rotational adjustment of an "L" shaped rod 60. Material guide 4' is removably attached to rod 60, and joint 7 allows rotational adjustment of material guide 4' about an axis in the horizontal plane. Different sized and shaped material guides may be used for different sizes and shapes of stock.

The reference numeral la (FIG. 8) generally designates another embodiment of the present invention, having a collar which can fit on either one of two rods to allow either counterclockwise or clockwise payoff of spooled material. Since dereeler 1*a* is similar to the previously described dereeler 1, similar parts appearing in FIGS. 1–7 and FIGS. 8–12 respectively are represented by the same corresponding reference numeral, except for the suffix "a" in the numerals of the latter. Dereeler 1*a* has a variable tension assembly 10*a* provided adjacent the base of a material control post 3*a* which has attached to it two rods 11*a* and 11*a*'. Variable tension assembly 10*a* also includes a collar 12*a* which can be attached to either rod 11*a* or 11*a*'. Collar 12*a* is movably attached to either rod 11*a* or 11*a*' by the tightening and loosening of a knob 100 which has a threaded portion 102 which acts as a set screw against rod 11*a* or 11*a*'. Collar 12*a* can be moved along either rod 11*a* or 11*a*' to adjust the tension in a spring 16*a* which is attached to collar 12*a* by using an "s" hook 39*a*. Dereeler 1*a* also includes a second rod 13*a* that is fixably attached to a frame 14*a* of dereeler 1*a*. An adjustable collar 15*a* is mounted on rod 13*a* and a knob 104 with a threaded portion (not shown) that works in the same manner as knob 100 to allow adjustment of collar 15*a* along rod 13*a* to adjust the tension in coil spring 16*a*.

Figure 8:
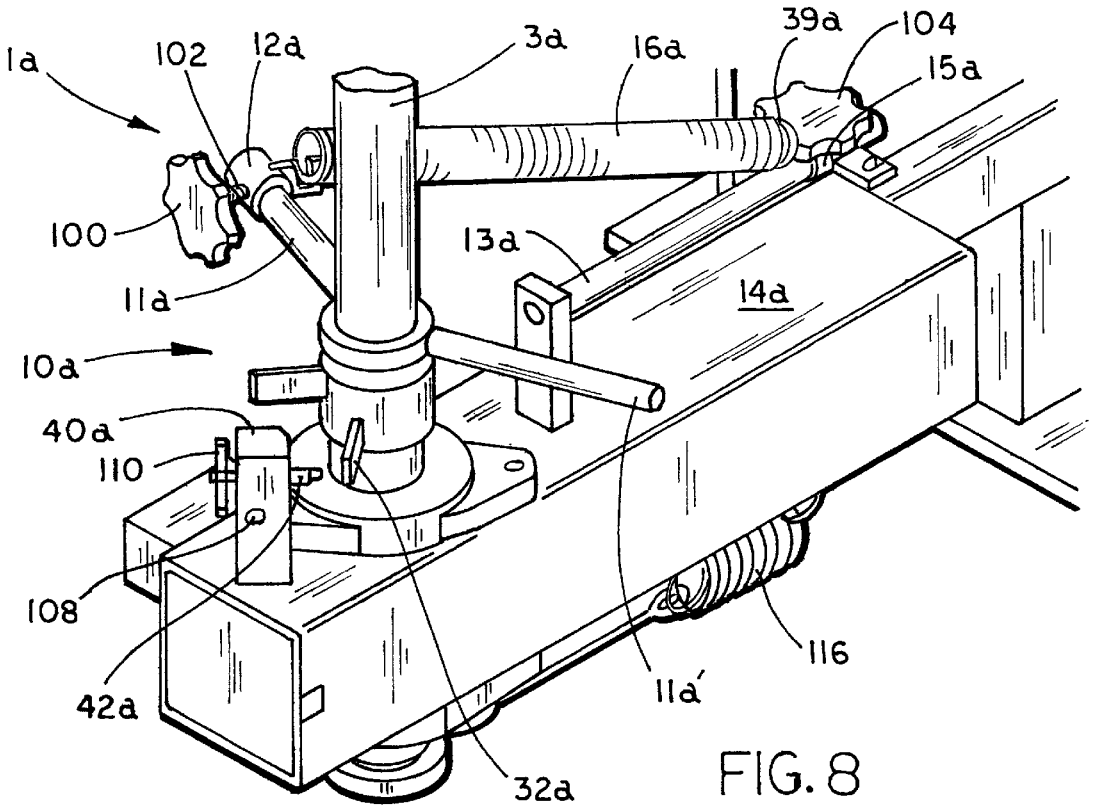
FIG. 8 is a fragmentary, perspective view of another embodiment of the present dereeler having a collar mounted on a first rod.
Figure 9:
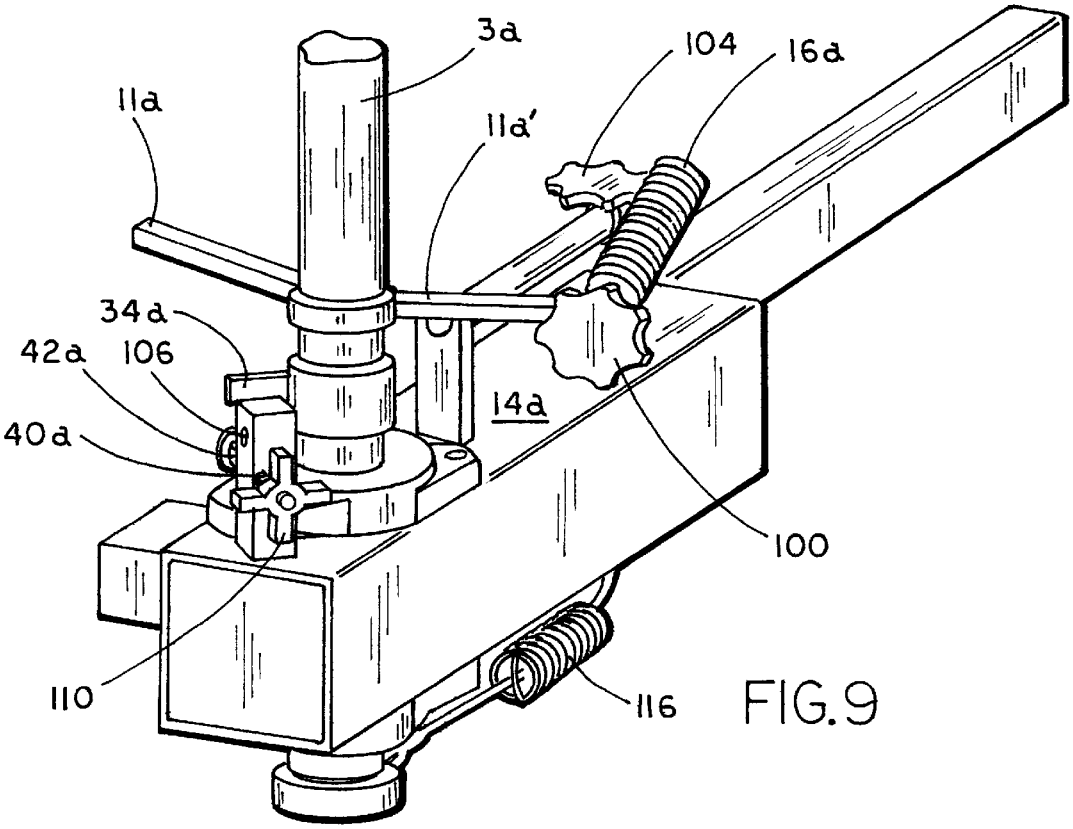
FIG. 9 is a fragmentary, perspective view of the dereeler illustrated in FIG. 8 shown with the collar mounted on a second rod.
Figure 10:
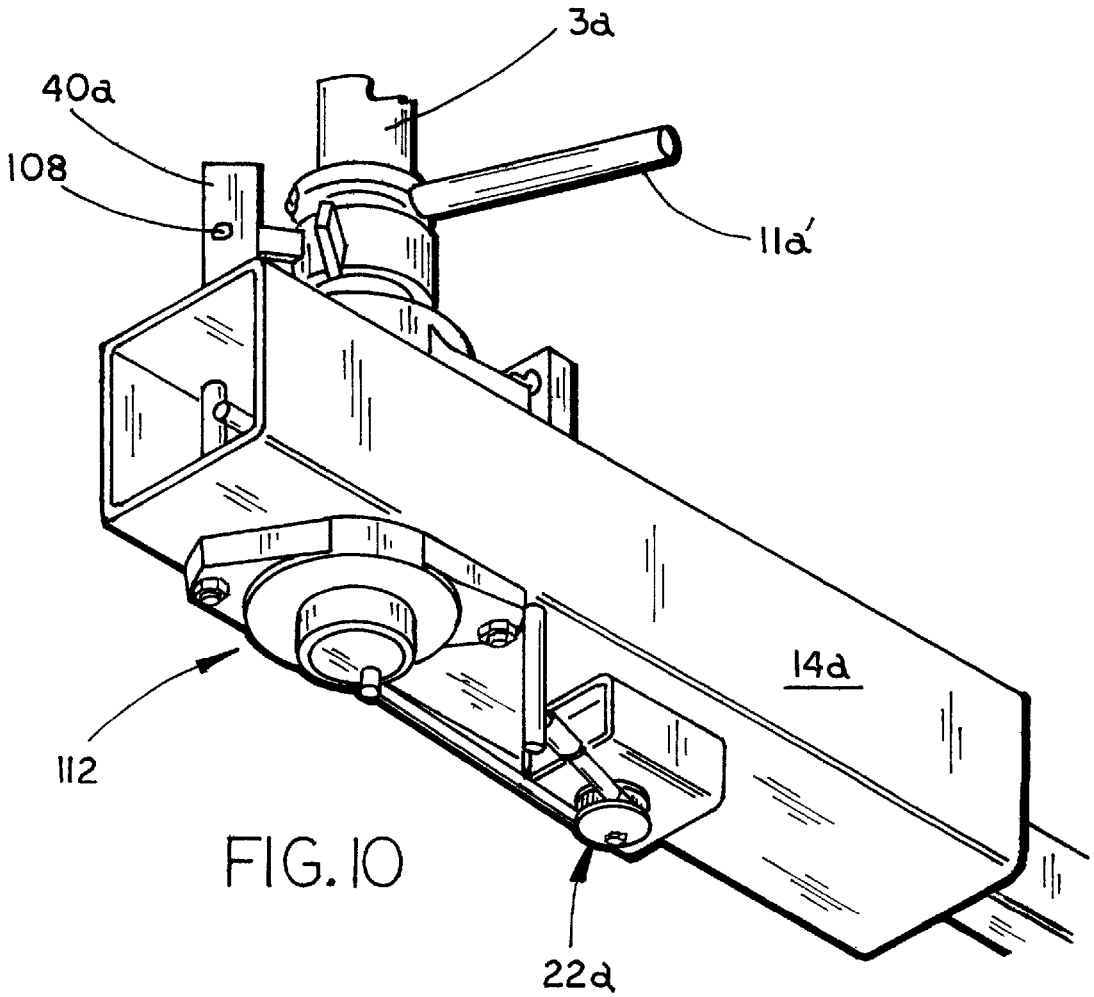
FIG. 10 is a fragmentary, perspective view of the dereeler illustrated in FIGS. 8 and 9 showing a potentiometer portion thereof.

Dereeler 1*a* includes a single bias plunger 42*a* which is slidably extended through a bore 106 (see FIG. 9) in a housing 40*a*. Plunger 42*a* can be adjusted to either engage an extension 32*a* when the material payoff is in a clockwise direction as in FIG. 8 or can easily be adjusted to extend in the perpendicular direction through a bore 108 to engage an extension 34*a* if material is being paid off in a counterclockwise direction. The plunger assembly includes a quick release finger nut 110 which is removed easily by unscrewing it in a counterclockwise direction. Quick release finger nut 110 will also hold the plunger in place very tight. When setting up to pay off material in the counterclockwise direction, plunger 42*a* is placed through bore 108 which is in a different plane from bore 106 (FIG. 9). Thus, this embodiment allows a user to quickly change the operation when a different material direction is required. A user can quickly and easily change both the rod to which collar 12*a* is attached and also quickly and easily change the direction of plunger 42*a*.

This embodiment also utilizes an analog proximity sensor 112 (FIG. 10) to control output voltage. The voltage is gauged by the distance from the center to a cam lobe rotated about the material control post 3*a*. This allows for bidirectional use of the arm without adjustment of sensor 112. This embodiment also utilizes a precision wound speed potentiometer 22*a* (FIG. 10) and a single spring 116 (see FIGS. 8 and 9) to control the output voltage. This allows the material control post freedom of direction.

Figure 7:
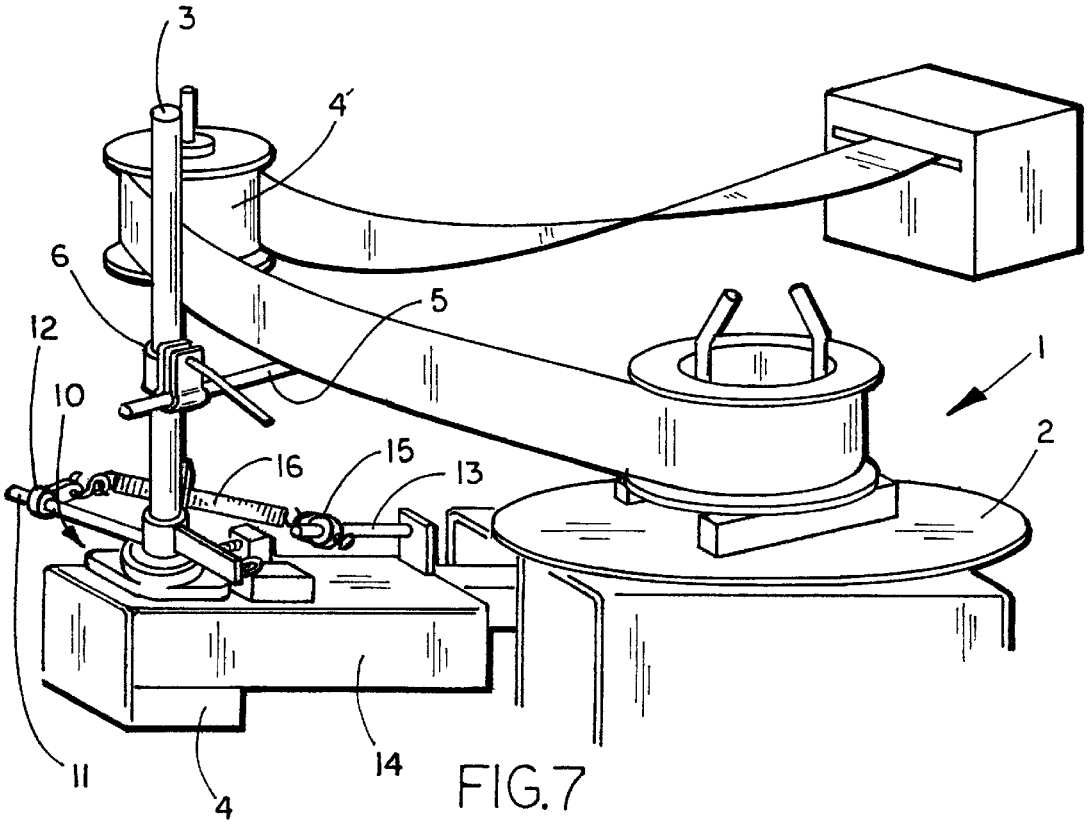
FIG. 7 is a fragmentary, side perspective view of the dereeler showing the material control post in a rotated position.

In operation, the tension applied to material control post 3 by coil spring 16 can be quickly and easily adjusted in accordance with the type of stock being payed from coil support platform 2 by adjusting collars 12 and 15 along rods 11 and 13, respectively. For example, if a relatively thick and/or wide coil stock is to be payed from coil support platform 2, the return tension from material control post 3 would normally be adjusted to a relatively high setting. To make this adjustment, the user loosens thumbscrew 36 on collar 12 and slides collar 12 (FIGS. 3 and 4) from the radially inner position shown in FIG. 3 to a position adjacent the free end of rod 11 (and retightening thumbscrew 36) such as shown in FIG. 4, thereby dramatically increasing the lever arm at which coil spring 16 acts on material control post 3. Because only the lever arm is significantly increased by this adjustment, and the length of coil spring 16 is not increased substantially, the position adjustment of collar 12 provides a significant change in tension and is very easily accomplished by the user. In the event still further tension is required, thumbscrew 38 is turned counterclockwise and collar 15 is adjusted inwardly toward frame 14 to provide additional pretension on coil spring 16. Adjustment of collar 15 is slightly harder than that for collar 12, but is still easily accomplished by the user. The user can also simply replace coil spring 16 with a stiffer spring 16*a*, 16*b* (FIG. 2) by detaching the opposite ends of the spring from the associated collars 12 and 15. Once the collars 12, 15 have been adjusted to provide the desired tension in coil spring 16, the dereeler 1 can be used to pay off stock by actuating motor 20 to provide a continuous pay off of stock from spool 8 around material guide 4' to the fabricating machine 26. As seen in FIG. 7, material control post 3 rotates about its longitudinal vertical axis during payoff, thereby causing material guide 4' to move from its initial position and resulting in a smooth payoff of stock to the fabricating machine 26. The material control post 3 can rotate until extension 32 engages plunger 42, whereby spring 46 will absorb the shock of the engagement. Coil spring 16 urges material control post 3 to its initial rotational position, resulting in increased performance of dereeler 1. The operation is the same for dereeler la with the exception of the use of knobs 100 and 104, and the potential for use when paying off stock in a counterclockwise direction.

The present invention provides an economical and easy way to adjust a dereeler for various thicknesses, widths and shapes of coiled metal stock for use in a fabricating machine. The present invention also provides a smooth pay off of the stock from the dereeler and easy adjustment from one size metal stock to another.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A dereeler for spooled strip and wire materials, comprising:

a platform shaped to support a spool of coiled material thereon in a normally generally horizontal orientation;

a motor operably connected with said platform and selectively rotating said platform in a normally generally horizontal plane to pay the coiled material off of the spool;

a material control post disposed in a generally vertical orientation and mounted for rotation about a normally vertical longitudinal axis of said material control post;

a control operably connected with said motor and said material control post to selectively actuate said motor and uncoil the coiled material from the spool in response to tension applied to the material;

a material guide connected with said material control post for rotation therewith, and being shaped to pass uncoiled material thereover and apply a preselected tension to the material to facilitate smooth material feeding; and a variable tensioner operably connected with said material control post and generating said preselected tension that is applied to the material; said tensioner being adjustable to vary said preselected tension, such that said dereeler can be adapted for use with a wide variety of differently sized spooled strip and wire materials.

2. A dereeler as set forth in claim 1, wherein:

said tensioner comprises:

a tensioning arm connected with and extending radially from said material control post;

a slide connector supported on said tensioner arm and adapted to slide longitudinally therealong; and a longitudinally extensible biasing member having one end thereof connected with said slide connector, such that shifting of said slide connector along said tensioning arm varies said preselected tension on the material.

3. A dereeler as set forth in claim 2, wherein:

said tensioner further comprises:

a base that is normally stationary having one end of said material control post rotatably mounted thereon;

an elongate anchor post mounted on said base and extending generally parallel with said biasing member; and a second slide connector supported on said anchor post and adapted to slide longitudinally therealong to vary said preselected tension on the material.

4. A dereeler as set forth in claim 3, wherein:

said slide connector defines a first slide connector, and includes a fastener for releasably attaching said slide connector to said tensioning arm at a selected location thereon.

5. A dereeler as set forth in claim 4, wherein:

said second slide connector includes a fastener for releasably attaching said second slide connector to said anchor post at a selected location thereon.

6. A dereeler as set forth in claim 5, wherein:

said biasing member comprises a coil spring.

7. A dereeler as set forth in claim 6, including:

first and second hooks detachably connecting the opposite ends of said coil spring to said first and second slide connectors to facilitate manual replacement of said coil spring.

8. A dereeler as set forth in claim 7, wherein:

said coil spring defines a first coil spring having first predetermined tension characteristics; and including a second coil spring shaped similar to said first coil spring for interchangeability therewith, and having second predetermined tension characteristics different from said first predetermined tension characteristics to vary said preselected tension on the material.

9. A dereeler as set forth in claim 8, wherein:

said control includes a potentiometer to determine the angular orientation of said material control post.

10. A dereeler as set forth in claim 9, including:

a support arm connecting said material guide with said material control post; and wherein said support arm has two adjustable joints to vary the orientation of said material guide.

11. A dereeler as set forth in claim 10, wherein:

said material guide defines a first material guide having a first shape to dispense a first type of spooled material, and is removably supported on said support arm; and including a second material guide adapted to be removably supported on said support arm, and having a second shape to dispense a second type of spooled material.

12. A dereeler as set forth in claim 1, wherein:

said tensioner further comprises:

a base that is normally stationary having one end of said material control post rotatably mounted thereon;

an elongate anchor post mounted on said base and extending generally parallel with said variable tensioner;

a slide connector supported on said anchor post and adapted to slide longitudinally therealong; and a longitudinally extensible biasing member having one end thereof connected with said slide connector, such that shifting of said slide connector along said anchor post varies said preselected tension on the material.

13. A dereeler for spooled materials, comprising:

a platform shaped to support a spool of coiled material thereon;

a motor operably connected with said platform and selectively rotating said platform to pay the coiled material off of the spool;

a material control post mounted for rotation about a normally vertical longitudinal axis of said material control post;

a control operably connected with said motor and said material control post to selectively actuate said motor and uncoil the coiled material from the spool in response to tension applied to the material;

a material guide connected with said material control post for rotation therewith, and being shaped to pass uncoiled material thereover and apply a preselected tension to the material to facilitate smooth material feeding; and a variable tensioner operably connected with said material control post and generating said preselected tension that is applied to the material; said tensioner including a tensioning arm connected with and extending radially from said material control post, a slide connector supported on said tensioning arm and adapted to slide longitudinally therealong, and a longitudinally extensible biasing member having one end thereof connected with said slide connector, such that shifting of said slide connector along said tensioning arm varies said preseleected tension on the material, whereby said dereeler can be adapted for use with a wide variety of different spooled materials.

14. A dereeler as set forth in claim 13, wherein:

said tensioner further comprises:

a base that is normally stationary having one end of said material control post rotatably mounted thereon;

an elongate anchor post mounted on said base and extending generally parallel with said biasing member; and a second slide connector supported on said anchor post and adapted to slide longitudinally therealong to vary said preselected tension on the material.

15. A dereeler as set forth in claim 14, wherein:

said slide connector defines a first slide connector, and includes a fastener for releasably attaching said first slide connector to said tensioning arm at a selected location thereon; and said second slide connector includes a fastener for releasably attaching said second slide connector to said anchor post at a selected location thereon.

16. A material decoiler comprising:

a coil support platform adapted to support a coil of wire stock in a generally horizontal orientation;

a control operably connected with said coil support platform to selectively uncoil said wire stock from said coil in response to tension applied to the wire stock;

a material control post mounted for rotation about a normally vertical longitudinal axis of said material control post in an initial position; and a variable tension assembly connected with said material control post and having an adjustable biasing member to allow rotational movement of said material control post while having adjustable tension to urge said material control post back to its said initial position.

17. The material decoiler defined in claim 16 wherein said variable tension assembly further includes a frame supporting said coil support platform, a first rod attached to said material control post, a second rod attached to said frame, a first adjustable collar mounted on said first rod, and a second adjustable collar mounted on said secondary rod, said biasing member removably attached to both of said adjustable collars and disposed in such a manner to urge said material control post to its said initial position.

18. The material decoiler defined in claim 17 wherein at least one of said adjustable collars is slidably mounted on one of said rods to allow adjustment of tension of said spring.

19. The material decoiler defined in claim 18 and further comprising a potentiometer in said control to determine the angular orientation of said material control post.

20. The material decoiler defined in claim 19 and further comprising a material guide attached to said material control post by an arm.

* * * * *